United States Patent [19]

Patrick et al.

[11] Patent Number: 5,015,297

[45] Date of Patent: May 14, 1991

[54] METHOD AND INSTALLATION FOR THE PRODUCTION OF ANHYDROUS CRYSTALLINE FRUCTOSE

[75] Inventors: Haon Patrick, Le Gorgue; Lemay Patrick, Lestrem, both of France

[73] Assignee: Roquette Freres, Lestrem, France

[21] Appl. No.: 501,377

[22] Filed: Mar. 29, 1990

Related U.S. Application Data

[63] Continuation of Ser. No. 271,704, Nov. 16, 1988, abandoned, which is a continuation of Ser. No. 863,016, May 14, 1985, abandoned.

[30] Foreign Application Priority Data

May 15, 1985 [FR] France ..... 85 07430

[51] Int. Cl.[5] ..... C13F 1/02

[52] U.S. Cl. ..... 127/58; 127/60; 127/61; 127/62; 127/63; 23/295 R

[58] Field of Search ..... 127/60, 58, 61, 62, 127/63; 23/295 R

[56] References Cited

U.S. PATENT DOCUMENTS

| | | | |
|---|---|---|---|
| 3,513,023 | 5/1970 | Kusch | 127/60 |
| 3,554,800 | 1/1971 | Javet et al. | 127/58 |
| 3,607,392 | 9/1971 | Lauer et al. | 127/58 |
| 3,642,534 | 2/1972 | DeChemoux | 127/60 |
| 3,704,168 | 11/1972 | Hara et al. | 127/60 |
| 3,928,062 | 12/1975 | Yamauchi | 127/60 |
| 3,929,503 | 12/1975 | Yamauchi | 127/58 |
| 3,981,739 | 9/1976 | Dmitrovsky et al. | 127/60 |
| 4,059,460 | 11/1977 | Schollmeier et al. | 127/61 |
| 4,620,880 | 11/1986 | Bodele et al. | 127/60 |
| 4,666,527 | 5/1987 | Ito et al. | 127/60 |

FOREIGN PATENT DOCUMENTS 2053019 2/1981 United Kingdom .

*Primary Examiner*—Asok Pal

*Attorney, Agent, or Firm*—Larson and Taylor

[57] ABSTRACT

Method for the production of anhydrous crystalline fructose in which the mass M subjected to crystallization traverses from top to bottom, continuously and with malaxation, a vessel 1 inside which it is subjected to a temperature gradient decreasing overall from top to bottom, the crystalline mass being recovered continuously at the bottom of the vessel, means being provided to take up at an intermediate level 8 a fraction of the mass M and to recycle it to a level 9 situated in the vicinity of the upper end of the vessel.

21 Claims, 1 Drawing Sheet

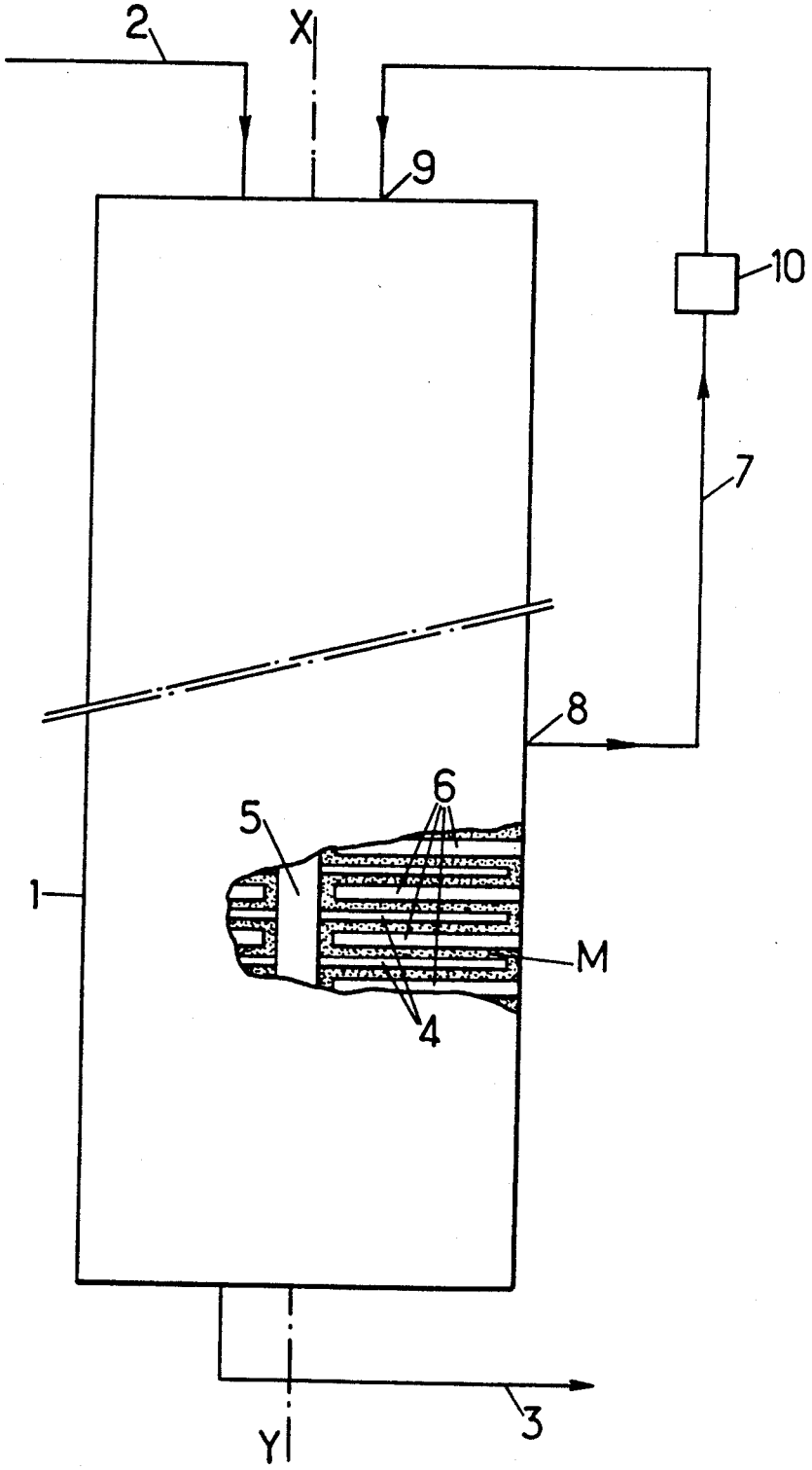
2
X
9
10
7
8
6
5
1
M
4
Y
3

METHOD AND INSTALLATION FOR THE PRODUCTION OF ANHYDROUS CRYSTALLINE FRUCTOSE

This application is a continuation of application Ser. No. 271,704 filed Nov. 16, 1988, now abandoned, which is a continuation of application Ser. No. 863,016 filed May 14, 1985, now abandoned.

The invention relates to a method and an installation for the production of anhydrous crystalline fructose.

It is known to prepare anhydrous crystalline fructose by cooling syrups rich in fructose in the presence of fructose crystals which play the part of crystallization seeds.

Known methods provide for dissolving a syrup rich in fructose in an alcohol or in water and slow cooling with simultaneous seeding and the operation of crystallization necessitates the employment of several malaxators of the horizontal type.

These known methods present particularly the drawback of necessitating at least two malaxators of which one plays the role of a foot; in addition, in the case of crystallization in an aqueous medium, the crystals obtained are of small size and difficult to purify under economical conditions.

The latest developments of these methods are reflected, particularly for crystallization in an aqueous medium, by French patent No. 2,128,835 filed Mar. 10, 1972 by the SUOMEN SOKERI OSAKEYHTIO Company and, for crystallization in an alcoholic medium, by French patent No. 1,596,220 filed by BOEHRINGER MANNHEIM on Dec. 20, 1980.

French Patent No. 2,128,835 discloses a method enabling the obtaining in an aqueous medium and continuously coarse crystals of fructose. This method has however the drawback of necessitating, for its continuous use, a sophisticated and very delicate apparatus.

U.S. Pat. No. 1,596,220 proposes a continuous crystallization method from a dilute fructose solution in methanol, the crystallization being partly performed in a vertical malaxator. This method, besides the fact that it is only applicable to dilute fructose solutions, requires an additional device for the preparation of the crystalline initiator.

These methods do not give entire satisfaction either from the point of view of productivity per unit volume of the equipment or from that of the energy balance.

Now, to face up the always more severe difficulties, particularly in the economic field, the Applicants have sought to develop a method and an installation of the type concerned which respond better than those preexisting, to the various desiderata of the practice, in particular precisely from the point of view of the productivity of the crystallization operation per unit volume of the equipment used and of the energy balance.

And they have found that this object could be achieved by means of a method characterized by the fact that a mass subject to crystallization traverses from top to bottom, continuously and with malaxation, a crystallization zone of vertical or inclined direction, in which there is established a temperature gradient decreasing globally downwards possibly modulated, that said crystallization zone is supplied in the vicinity of its upper end, on the one hand, with fructose syrup having a richness in fructose higher than 90%, preferably higher than 93% and a proportion of dry matter higher than 70%, preferably from 75 to 95% by weight and, on the other hand, with mass subject to crystallization which is taken up and recycled from an intermediate level of the crystallization zone, spaced from its ends by at least one sixth, preferably one fifth and still more preferably one fourth of the total length of said zone, the amount of mass subject to crystallization and recycled representing by volume from 10 to 120%, preferably from 40 to 110% and still more preferably from 80 to 100% of the amount of fructose syrup introduced into the zone, and that there is extracted, continuously, in the vicinity of the lower end of the crystallization zone, a product highly enriched in anhydrous fructose crystals from which said crystals are recovered.

To practise the abovesaid method, recourse is had, according to the invention, to an installation comprising essentially a crystallization vessel of vertical or inclined axis and equipped with a system of supply of fructose syrup in the vicinity of its upper end, with a system of malaxation and a system of temperature regulation adapted to establish inside the vessel and within the mass subjected to crystallization contained in the vessel, a temperature gradient decreasing globally from top to bottom possibly modulated, with a system of continuous extraction in the vicinity of its lower end, of a product highly enriched in anhydrous fructose crystals which is conducted by suitable means to a system adapted to recover the crystals from this product, and with means adapted to take up at an intermediate level of the vessel, spaced from the ends of the latter by at least one sixth, preferably one fifth and still more preferably one fourth of its total length, an amount of mass subjected to crystallization which corresponds, in volume, to 10 to 120%, preferably to 40 to 110% and still more preferably to 80 to 100% of the amount of fructose syrup introduced in the vicinity of the upper end of the vessel, said means adapted to take up the mass subject to crystallization being in addition adapted to recycle it into the vessel at a level preferably close to the upper end of the latter.

The invention is aimed also at other features which are preferably used at the same time and which will be more explicitly discussed below.

And it will, in any case, be well understood by means of the additional description which follows and the accompanying drawing which relates to advantageous embodiments.

The single figure of the drawing shows diagramatically an installation according to the invention.

In order to produce anhydrous crystalline fructose according to the invention, procedure is as follows or in equivalent manner.

As raw material, there are used fructose syrups obtained, for example, from a starch hydrolysate which is isomerised and then enriched by chromatography, having a content of dry matter of about 75 to 95% by weight, the fructose constituting at least 90% and, preferably a proportion higher than 93% by weight of the dry matter of the syrup; said syrup contains besides generally from 0.1 to 4% of a mixture of di-, tri- and polysaccharides, the balance up to 100 being essentially constituted of glucose.

According to a particular embodiment of the invention, the fructose syrup concerned, of richness higher than 90%, contains from 6 to 30% of water or of a wateralcohol mixture, of which the alcohol can be ethanol, methanol or isopropanol or a mixture of these alcohols.

This concentrated syrup is brought to a vertical or inclined crystallization zone, which it traverses continuously from top to bottom from a point situated in the vicinity of its upper end and within which it is subjected, in the presence of fructose crystals playing the role of crystallization seeds, to malaxation and to a temperature gradient decreasing globally from top to bottom.

The temperature of the syrup is brought or maintained, at the moment of its introduction into the crystallization zone, at a value selected within the range from 40° to 80° C., preferably of 45° to 65° C. and, in practice, from 48° to 55° C.

The temperature gradient established inside the crystallization zone within the mass subjected to crystallization corresponds to a reduction of 0.2° to 2° C., preferably from 0.4° to 1.5° C. and still more preferably from 0.5° to 1° C. per hour of treatment and is such that at the outlet of said zone, at a point situated in the vicinity of the lower end of the latter, the mass subjected to crystallization which comprises the syrup, the crystals initially present, the grown crystals and those as the case may be formed by the crystallization phenomenon, is brought to a temperature situated within a range from 5° to 40° C. preferably from 15° to 40° C. and still preferably from 15° to 30° C.

Progressively as the mass subjected to crystallization approaches the lower end of the crystallization zone, its richness in anhydrous fructose crystals increases, said mass forming at the outlet of the zone a "mass rich in crystals".

The production, in the vicinity of the lower end of the crystallization zone of a mass rich in crystals which can be extracted continuously without disturbing the parameters of the crystallization process, which disturbance would have repercussions at the level of the subsequent separation step of the liquid phase and crystals and which could necessitate intermittent stoppages of the installation, in other words the placing at the disposal of the user of a method enabling the achievement of a productivity per unit volume of the equipment used higher than that of the installations according to the prior art, is rendered possible, according to the invention, due to the taking up, at an intermediate level of the crystallization zone, spaced from the ends of the latter by at least one sixth of its total length, of a fraction of the mass subjected to crystallization which is recycled and reintroduced into the crystallization zone at a level in the vicinity of its upper end.

The fraction taken up and recycled represents, in volume, from 10 to 120%, preferably from 40 to 110% and more preferably still from 80 to 100% of the volume of fructose syrup supplying the crystallization zone.

In a preferred embodiment, the recycled fraction is subjected to a treatment adapted to fragment the crystals contained in this fraction in order to increase the number of seeds and to break aggregates of crystals if any; this treatment can be carried out by means of a grinder.

The feed flow rate of fructose syrup is selected so that the average dwell time, of a given fraction of the mass subjected to crystallization within the crystallization zone is from 30 to 120 hours, preferably from 50 to 90 hours and still more preferably from 60 to 75 hours; the value selected depends on the heat exchange capacities of the means comprised by the zone and by means of which is established, within said zone inside the mass subjected to crystallization, the decreasing temperature gradient.

The intermediate level at which the taking up is performed of the fraction subjected to crystallization which is intended for recycling, is preferably spaced from the ends of the crystallization zone by at least one sixth of the total length of the latter and, in practice, of the order of at least one fifth and preferably of one fourth of the total length of said zone.

The viscosity of the mass subjected to crystallization increases progressively as the proportion of anhydrous fructose crystals grows, that is to say in the descending direction. The installation is therefore, preferably, equipped with delivery or aspiration means adapted to ensure the transportation of the mass inside the zone.

In addition, the means of malaxation and of homogenization comprised by the installation must be arranged so &hat dead zones are avoided and so that the heat exchange between the mass subjected to crystallization and the cooling means are as efficient as possible.

The product extracted from the crystallization zone and which constitutes, as already indicated, a mass rich in crystals, comprises anhydrous fructose crystals of a granulometric spectrum characterized by a low proportion of fines and of coarse crystals and hence by a high proportion of crystals of intermediate size, this spectrum not varying over time, due to which the subsequent treatment step, which consists of separating these crystals from the liquid phase in which they are contained, is not subject to disturbance.

This separation comprises a centrifugal draining and as the case may require a washing due to which the major part of the liquid phase is recovered; the latter forms mother liquors of which the concentration in fructose is less than that of the starting fructose syrup —this concentration generally reaches from 75 to 92%—and in which almost the whole of the mono-, di-, tri- and polysaccharides contained in the starting fructose syrup is to be found again.

The mother liquors collected can be partially recycled.

BRIEF DESCRIPTION OF DRAWINGS

Now, in order to carry out the method according to the invention, it is possible to resort to a single container 1 having the shape of a cylinder of revolution of axis XY.

The axis XY is positioned advantageously along the vertical but may also by inclined.

The vessel is equipped

- with a system of supplying fructose syrup at the level of the upper end of the vessel and represented diagramatically by a pipe 2,
- with a system of malaxation and of regulation of temperature which will be further discussed and
- with a system of continuous extraction at the level of the lower end of the vessel and shown diagramatically by a pipe 3, this system being adapted to recover the crystalline mass obtained at the outlet of the crystallization zone.

The system of malaxation and of regulation of temperature which is mentioned above may advantageously comprise a group of malaxation arms 4 borne at regular intervals by a rotary shaft 5 whose axis is merged with the axis XY of the vessel, cooling sheets 6 arranged in alternation with malaxation arms 4 and borne by the wall of the vessel 1, these cooling sheets being traversed by a cooling fluid.

According to the invention, the vessel comprises in addition means shown globally at 7 and adapted to take up at an intermediate level 8 of the vessel, spaced from the ends of the vessel by at least one sixth, preferably 1/5 and still more preferably one fourth of the total length of the vessel, a fraction of the mass M subject to crystallization and passing through the vessel from top to bottom and to recycle this fraction to a level 9 situated preferably in the vicinity of the upper end of the vessel.

The heat exchange capacity, the temperature regulation system, the rotary speed of the malaxation means and the speed with which the mass subject to crystallization passes through the vessel, that is to say the average dwell time of a given fraction of this mass inside the vessel, are selected so that there is established, in the whole of the mass subjected to crystallization, the temperature gradient provided according to the invention.

Preferably, the means represented globally at 7 comprise a device 10 for fragmentation of the crystals contained in the recycled fraction; this device 10 may be constituted by a grinder.

It is pointed out that, in practice, the cooling fluid is water and that the average difference in temperature a a given point of the vessel between this water and the mass subject to crystallization, is of the order of 5° to 15° C.

EXAMPLE 1

(a) Recourse is had to an installation according to the invention comprising a single cylindrical vessel of useful volume 50 $m^3$ and equipped with a grinder.

There is introduced into this vessel, with a flow rate of 0.75 $m^3$ per hour, a fructose syrup having a content of sugar dry matter of 90% and comprising 94% by weight on dry matter of fructose, the remaining 6% being constituted by 3% of glucose and by 3% of di-, tri- and polysaccharides.

This syrup contains 10% of a mixture of 49% water and 51% alcohol; this syrup has a density of 1.45.

The temperature of the syrup at the inlet of the vessel is about 50° C.

Simultaneously a fraction of the mass in course of crystallization is taken up at a substantially middle level of the vessel is recycled with a flow rate of 0.7 $m^3$ per hour and treated with the grinder.

The average duration of passage inside the vessel of a given fraction of the mass subject to crystallization is about 66 hours.

The mass rich in crystals extracted at the level of the lower end of the vessel is found to be at a temperature close to 15° C., the overall temperature gradient decreasing from top to bottom corresponding therefore to about 0.5° C. per hour.

The fructose content of the mother liquors recovered after separation of the anhydrous fructose crystals is 85.6% on the dry matter, the complement to 100 being constituted by mono-, di-, tri- and polysaccharides which have not crystallized.

The crystallization yield which is given by the formula:

$$r = \frac{A - H}{100 - H}$$

in which

A, which represents the richness in fructose of the feed syrup, is equal to 94% and H, which represents the richness of the mother liquors, is equal to 85.6%, is established at 58.3%.

13.0 tons of anhydrous fructose are produced daily, which corresponds to productivity of 0.260 ton daily and per $m^3$ of the vessel.

This result is distinctly superior to that which is obtained in crystallization of the same fructose syrup in a horizontal reactor whose productivity is established at 0.2 ton per $m^3$ of the vessel 3 and daily.

In addition, no disturbance necessitating the stoppage of the installation is produced, and it operates continuously.

The crystals collected after centrifugal draining and washing show excellent physical and chemical properties.

These crystals are of 99.8% purity, their flow index is good and their granulometric distribution is as follows:

| | |
|---|---|
| crystals of size greater than 1250 microns | 5% |
| crystals of size comprised between 1250 and 500 microns | 45% |
| crystals of size comprised between 500 and 200 microns | 45% |
| crystals of size less than 200 microns | 5%. |

(b) The equipment and the operational conditions of example 1 are used.

However, at a given moment, after having reached the equilibrium of the system, the recycled fraction is taken up no longer at an intermediate level but at a point of the vessel situated in the last sixth of the total height.

There is then rapidly witnessed a development of the parameters of the crystallization which is manifested after some hours by poor separation at the level of the turbines and which finishes by necessitating the stoppage of the installation and the removal of the mass that it contains before starting up again under the conditions according to the invention.

EXAMPLE 2

(a) The equipment and operational conditions of example 1 are used.

The installation is again supplied at the rate of 0.75 $m^3$ per hour but with a fructose syrup composition which only differs from that used in the preceding example by the fact that it contains 15% water and no alcohol.

The temperature of the syrup at the inlet of the vessel is about 52° C.

Simultaneously a fraction of the mass in course of crystallization taken up at a substantially middle level of the vessel is recycled with a flow rate of 0.6 $m^3$ per hour. This mass is ground in order to break crystal aggregates if any.

The mass rich in crystals extracted at the level of the lower end of the vessel has a temperature close to 20° C., the temperature gradient having a value of 0.5° C. per hour.

The content in fructose of the mother liquors recovered after separation and washing of the crystals of anhydrous fructose is 90% on dry matter, the complement to 100 being constituted by mono-, di-, tri- and polysaccharides which have not crystallized.

The yield of the crystallization is 40% after washing of the crystals.

Under these conditions, there are produced daily 8.6 tons of pur anhydrous fructose, which corresponds to a productivity of 0.172 ton daily and per $m^3$ of the vessel.

There is again observed great regularity at the level of operation of the installation and great facility at the level of the centrifugation of the crystals.

These crystals are of 99.9% purity, their flow index is good and their granulometric distribution is as follows:

| | |
|---|---|
| crystals of size greater than 1250 microns | 4% |
| crystals of size comprised between 1250 and 500 microns | 47% |
| crystals of size comprised between 500 and 200 microns | 46% |
| crystals of size less than 200 microns | 3%. |

(b) As in the preceding example, after having reached equilibrium in operation, the recycled fraction is taken up at a point of the vessel situated in the last sixth of the overall height.

There is again observed a change in the crystallization parameters and it is necessary to stop the installation for the same reasons and after some days.

Besides an improvement in the productivity per $m^3$ of reactor, the invention enables continuous and regular crystallization of anhydrous fructose of high chemical purity and having a homogeneous granulomeric distribution.

What is claimed is:

1. A method for the production of anhydrous crystalline fructose having a granulometric spectrum constant over time and characterized by a low proportion of fine and coarse crystals and by a high proportion of crystals of intermediate size, the said method comprising the steps of selecting a crystallization zone having an upper and a lower end and establishing therein a temperature gradient decreasing globally downwards, introducing continuously and under malaxation into the said crystallisation zone at a level close to its upper end a fructose syrup having a richness in fructose higher than 90% by weight and a concentration in dry matter higher than 70% by weight, causing said syrup to travel under malaxation through said crystallization zone from the upper to the lower end in the presence of fructose crystals acting as crystallization seeds, said syrup and said crystals forming a mixture, taking up from an intermediate level of the crystallization zone spaced from its ends by at least on sixth of the total length of said crystallization zone a fraction of the said mixture travelling through the said crystallization zone, said fraction representing from 40 to 110% by volume of the amount of fructose syrup introduced into the said crystallization zone, recycling said fraction to a level close to the upper end of the crystallization zone, subjecting the recycled fraction to a treatment adapted to fragment the crystals contained in this fraction in order to increase the number of seeds and to break aggregates of crystals, collecting from a level close to the lower end of the crystallization zone a product highly enriched in anhydrous fructose crystals, recovering said anhydrous crystals from said product.

2. A method according to claim 1, wherein the crystallization zone is of vertical direction.

3. A method according to claim 1, wherein the crystallization zone has is of inclined direction.

4. A method according to claim 1, wherein the temperature gradient established inside the crystallization zone is modulated.

5. A method according to claim 1, wherein the fructose syrup introduced into the crystallization zone has a richness in fructose higher than 93% by weight.

6. A method according to claim 1, wherein the fructose syrup introduced into the crystallization zone has a concentration in dry mater comprised between 75 and 95% by weight.

7. A method according to claim 1, wherein the fraction of the said mixture travelling through said crystallization zone which is taken up from an intermediate level of the said zone and recycled to a level close to its upper end represents by volume from 80 to 100% of the amount of fructose syrup introduced into the crystallization zone.

8. A method according to claim 1, wherein the intermediate level of the said crystallization zone form which is taken up a fraction of the said mixture travelling through said zone is spaced from the ends of the crystallization zone by at least one fifth of the total length of said zone.

9. A method according to claim 1, wherein the intermediate level of the said crystallization zone from which is taken up a fraction of the said mixture travelling through said zone is spaced from the ends of the crystallization zone by at least one fourth of the total length of said zone.

10. A method according to claim 1, wherein the temperature of the syrup introduced into the crystallization zone is at the moment of its introduction into the crystallization zone form 40° to 80° C, the temperature gradient established inside the crystallization zone corresponds to a reduction of 0.2° to 2° C. per hours, and at the level close to the lower end of the crystallization from which is collected the product highly enriched in fructose crystals, the temperature of the said product is from 5° to 40° C.

11. A method according to claim 1, wherein the temperature of the syrup introduced into the crystallization zone is at the moment of its introduction into the crystallization zone from 45° to 65° C., the temperature gradient established inside the crystallization zone corresponds to a reduction of 0.4° to 1.5° C. per hour, and at the level close to the lower end of the crystallization from which is collected the product highly enriched in fructose crystals, the temperature of the said product is from 15° to 40° C.

12. A method according to claim 1, wherein the temperature of the syrup introduced into the crystallization zone is at the amount of its introduction into the crystallization zone from 48° to 55° C., the temperature gradient established inside the crystallization zone corresponds to a reduction of 0.5° to 1° C. per hours, and at the level close to the lower end of the crystallization from which is collected the product highly enriched in fructose crystals, the temperature of the said product is from 15° to 30° C.

13. A method according to claim 1, wherein the fructose syrup is introduced into the crystallization zone at a feed flow rate such that a given fraction of the mixture travelling through said zone has an average dwell time inside the crystallization zone of 30 to 120 hours.

14. A method according to claim 1, wherein the fructose syrup is introduced into the crystallization zone at a feed flow rate such that a given fraction of the mixture travelling through said zone has an average dwell time inside the crystallization zone of 50 to 90 hours.

15. A method according to claim 1, wherein the fructose syrup is introduced into the crystallization zone at a feed flow rate such that a given fraction of the mixture travelling through said zone has an average dwell time inside the crystallization zone of 60 to 75 hours.

16. A method according to claim 1, wherein the fructose syrup introduced into the crystallization zone has a concentration in dry matter from 75 to 95% by weight, the proportion of fructose with respect to the dry matter being at least 90% by weight.

17. A method according to claim 1, wherein the fructose syrup introduced into the crystallization zone has a concentration in dry matter from 75 to 95% by weight, the proportion of fructose with respect to the dry matter being at least 93% by weight.

18. A method according to claim 1, wherein the fructose syrup introduced into the crystallization zone contains from 6 to 30% of at least one of the products of the group consisting of water and of mixtures of water with ethanol, methanol and isopropanol.

19. A method according to claim 1, comprising the steps of selecting a crystallization zone having an upper and a lower end and establishing therein a temperature gradient of 0.5° C. to 1° C. per hour, introducing continuously and under malaxation into the said crystallisation zone at a level close to its upper end a fructose syrup having a richness in fructose higher than 93% by weight, a concentration of dry matter comprised between 75 and 95% by weight and a temperature from 48° to 55° C., causing said syrup to travel under malaxation through said crystallization zone from the upper to lower end in the presence of fructose crystals acting as crystallization seeds, said syrup and said crystals forming a mixture.

taking up from an intermediate level of the crystallization zone spaced from its ends by at least one fourth of the total length of the crystallization zone a fraction of the mixture travelling through the said zone, said fraction representing from 80 to 100% by volume of the amount of fructose syrup introduced into the zone, recycling said fraction to a level close to the upper end of the crystallization zone, subjecting the recycled fraction to a treatment adapted to fragment the crystals contained in this fraction in order to increase the number of seeds and to break aggregates of crystals, collecting from a level close to the lower end of the crystallization zone a product highly enriched in anhydrous fructose crystals, said product having a temperature from 15° to 30° C., recovering said anhydrous crystals from said product.

20. A method according to claim 1, comprising the steps of selecting a crystallization zone having an upper and a lower end and establishing therein a temperature gradient of 0.5° C. to 1° C. per hour, introducing continuously and under malaxation into the said crystallisation zone at a level close to its upper end a fructose syrup having a richness in fructose higher than 93% by weight, a concentration of dry matter comprised between 75 and 95% by weight and a temperature from 48° to 55° C., causing said syrup to travel under malaxation through said crystallization zone from the upper to the lower end in the presence of fructose crystals acting as crystallization seeds, said syrup and said crystals forming a mixture, taking up from an intermediate level of the crystallization zone which is substantially the middle of the crystallization zone, a fraction of the mixture travelling through the said zone, said fraction representing from 80 to 100% by volume of the amount of fructose syrup introduced into the zone, recycling said fraction to a level close to the upper end of the crystallization zone, subjecting the recycled fraction to a treatment adapted to fragment the crystals contained in this fraction in order to increase the number of seeds and to break aggregates of crystals, collecting from a level close to the lower end of the crystallization zone a product highly enriched in anhydrous fructose crystals, said product having a temperature form 15° to 30° C., recovering said anhydrous crystals from said product.

21. A method according to claim 1, wherein the treatment adapted to fragment the crystals contained in the recycled fraction is carried out by way of a grinder.

* * * * *